US005537850A

United States Patent [19]

Inatani

[11] Patent Number: 5,537,850

[45] Date of Patent: Jul. 23, 1996

[54] METHOD OF SHAPING A WHEEL

[75] Inventor: Shujiro Inatani, Osaka, Japan

[73] Assignee: Rays Engineering Co., Ltd., Osaka, Japan

[21] Appl. No.: 467,391

[22] Filed: Jun. 6, 1995

Related U.S. Application Data

[63] Continuation of Ser. No. 166,002, Dec. 14, 1993, abandoned.

[30] Foreign Application Priority Data

| | | | |
|---|---|---|---|
| Dec. 18, 1992 | [JP] | Japan | 4-399164 |
| Dec. 22, 1992 | [JP] | Japan | 4-341995 |
| Dec. 28, 1992 | [JP] | Japan | 4-348788 |

[51] Int. Cl.[6] ..... B21D 22/16

[52] U.S. Cl. ..... 72/85; 72/71; 72/110

[58] Field of Search ..... 72/68, 70, 71, 72/84, 85, 110; 29/168, 892.3, 893.32, 894.324

[56] References Cited

U.S. PATENT DOCUMENTS

| | | | |
|---|---|---|---|
| 1,306,262 | 6/1919 | Knowles | 72/68 |
| 2,075,294 | 3/1937 | Le Jeune | 29/894.324 |
| 2,679,089 | 5/1954 | Opitz et al. | 72/126 |
| 3,461,701 | 8/1969 | Marcovitch | 72/110 |
| 3,566,503 | 3/1971 | Pacak . | |
| 3,712,098 | 1/1973 | Shaffer et al. . | |
| 3,717,017 | 2/1973 | Vukovich | 72/68 |
| 3,893,818 | 7/1975 | Mickus . | |
| 4,413,496 | 11/1983 | Diemer et al. . | |
| 4,669,291 | 6/1987 | Asari et al. . | |
| 4,722,211 | 2/1988 | Tsukamoto et al. | 72/70 |

FOREIGN PATENT DOCUMENTS

| | | | |
|---|---|---|---|
| 59-169638 | 9/1984 | Japan . | |
| 87020 | 3/1989 | Japan | 72/85 |
| 2187406 | 9/1987 | United Kingdom | 72/85 |

*Primary Examiner*—Lowell A. Larson
*Attorney, Agent, or Firm*—Law Office of Steven M. Rabin

[57] ABSTRACT

A process of making wheels in which a pair of rams press an initial mass of material for shaping a central disc part. A portion of the material is extruded out from between the interface of the rams. A roller unit having several rollers simultaneously forms rim parts by pressing the extruded material into desired shapes as it passes beyond the periphery of the rams.

23 Claims, 8 Drawing Sheets

METHOD OF SHAPING A WHEEL

This application is a continuation, of application Ser. No. 08/166,002, filed Dec. 14, 1993, now abandoned.

FIELD OF THE INVENTION

This invention relates to a method of shaping various types of wheels that include a disc part and a rim part which are made from materials having high plasticity, for instance, aluminum alloys or magnesium alloys.

BACKGROUND OF THE INVENTION

This application claims tile priority of Japanese Patent Application No. 399164/1992 filed Dec. 18, 1992, No. 341995/1992 filed Dec. 22, 1992 and No. 348788/1992 filed Dec. 28, 1992, which are incorporated herein by reference.

Automobile wheels or transmission pulleys are formed into a disc part and a peripheral rim part which is roughly perpendicular to the disc part in a unified body. An automobile wheel is once formed into a dish-shaped body having a disc part and an annular part perpendicular to the disc part. The annular part is further shaped into a drop center part (23), an outer rim part (22) and an inner rim part (24), as shown in FIG. 1(*a*) and FIG. 1(*b*). A pulley is formed by first forming a dish-shaped body with a central disc part and a peripheral annulus. The annulus is further finished into a rim part which will wear a belt. The dish-shaped prototype is generally formed by several steps of forging, for instance, from a block or a disc (an initial material) of a light metal alloy.

A Prior method disclosed in Japanese Patent Publication No. 3-2574 works a dish-shaped prototype into the final shape by forging, except for an annular part. The peripheral annular part is then formed into a determined rim part by a rolling process. The conventional method requires an extremely high pressure for forging, while the initial material is being transformed into the dish-like body. The dish-like prototype has a central disc part and a peripheral annulus perpendicular to the disc part. The forging process must expand and bend forcibly the peripheral portion of the block or disc initial material toward the annular wall in rams. The initial material resists the deformation in the rams (alternatively called dics or molds). The resistance against expansion is very large. Thus the forging demands an immense pressure. If an initial material were to be deformed only by a single forging process into a dish-like body, the forging would require a huge forging machine, a giant pressing machine for supplying a sufficient pressure to the forging machine and a big ram for enduring the large pressure. The use of large machines is impractical. Thus, the conventional method divides the deformation from an initial block to a dish-like body into several partial processes. Each partial process deforms the material a bit with a small pressure. The reduction of the required pressure in partial processes decreases the size of forging machines.

Poor productivity, however, accompanies the conventional method that includes plural partial processes. The method requires various rams for all partial processes, long processing time from the initial material to the dish-like prototype, and extra time for transferring the bodies between machines. Thus, it takes a long time to produce the wheel having a disc part and a rim part, because the formation of the wheel requires additional process to the dish-like prototype. The divisional, partial processes lowers productivity in producing the wheels.

An object of this invention is to provide a method with fewer steps for shaping a wheel from a metal, plastic material. Another object of this invention is to provide a method of shaping a wheel which can reduce the process time. A still further object of this invention is to provide a method which can reduce the number of rams.

SUMMARY OF THE INVENTION

The method of this invention comprises the steps of pressing an initial material (10) by a pair of metallic rams (301) and (302) that face each other in an axial direction for forming a disc part, extruding a peripheral portion out of the rams, and shaping a peripheral portion into a rim part by a unit of rollers which rotate relatively to the rams.

Functions of this method will be explained now. The initial material (10) is sandwiched by a pair of the rams (301) and (302). The rams press the initial material in an axial direction. The material is squashed into a disc part. The peripheral, extra portion is extruded out from between the rams (301) and (302). Over the boundary of the rams and is pressed from the side directions by a unit of rollers which rotate relative to the rams. Namely, if the pal r of the rams do not rotate, the rollers are rotated. If the rams rotate, the rollers are at rest. In this ease, the rollers can be displaced a little in a radial direction or an axial direction for adjustment. In any case, the rollers can form rim parts by the rotation relative to the rams.

The pressure applied between the pair of the rams is comparatively small, while the rollers are shaping the rim parts. The extruded portion is in contact only with the rollers. Thus, the resistance against the extension of material according to the method of the invention is still smaller than the extension resistance of the prior method in which a pair of rams press all of a material between wide, curved surfaces in order to form a wheel in one pressing step. This invention can reduce the force of the rams.

The advantages of this invention include high productivity, that is, short time requirements for formation and a requirement for only a small number of metallic rams. Therefore, this invention can produce wheels at a low cost.

BRIEF DESCRIPTION OF THE DRAWINGS

FIG. 1(*b*) is an enlarged sectional view of another wheel having a rim part alone.

DETAILED DESCRIPTION OF PREFERRED EMBODIMENTS

Embodiments of this invention are explained in accordance with figures.

EMBODIMENT 1

Figure 1A:
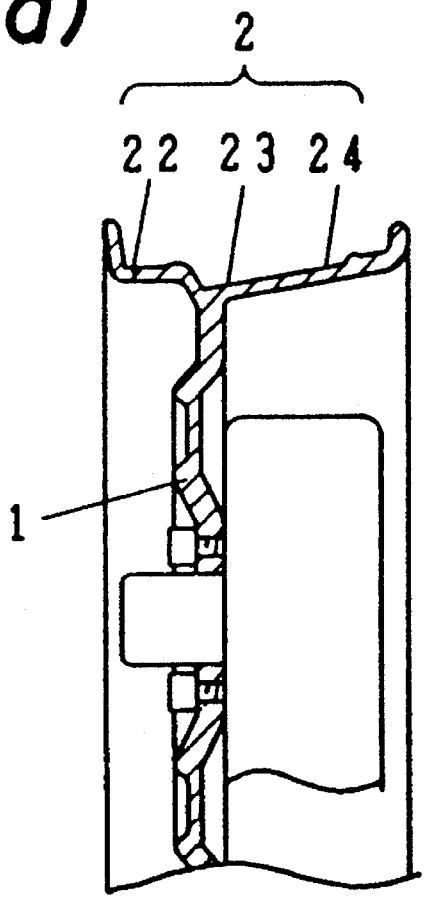
FIG. 1(*a*) is a sectional view of a wheel body having a disc part and a rim part.
Figure 1B:
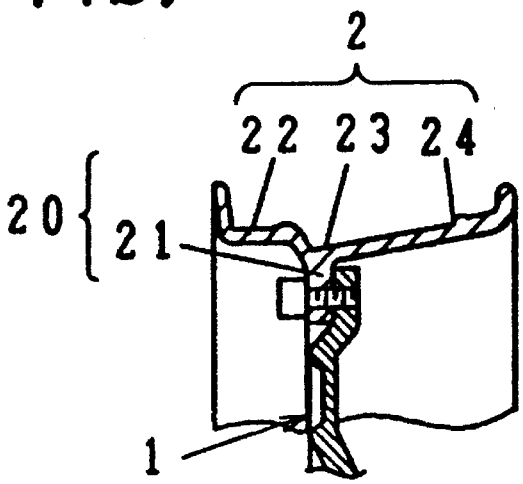
Figure 2:
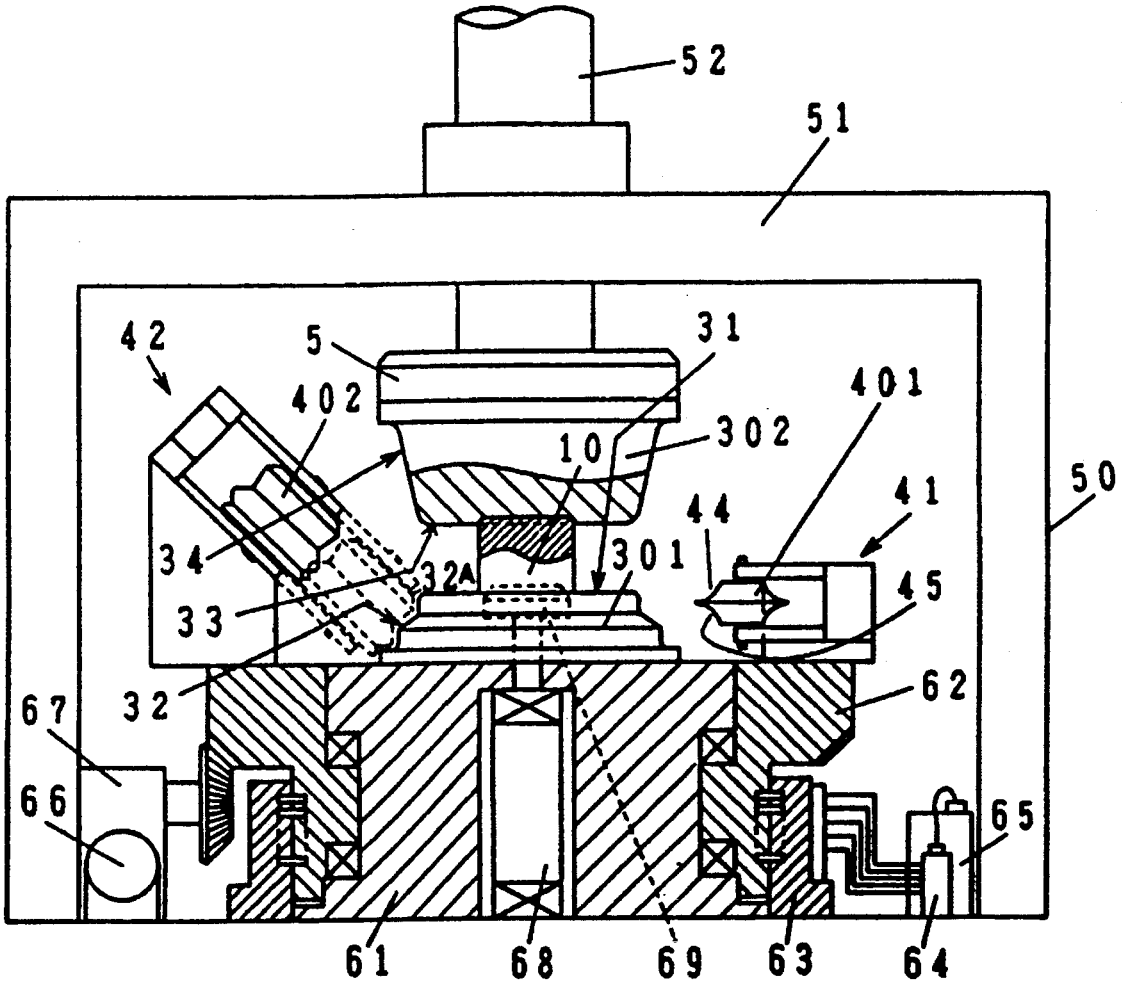
FIG. 2 is a sectional view of the apparatus for putting this invention into effect.
Figure 3:
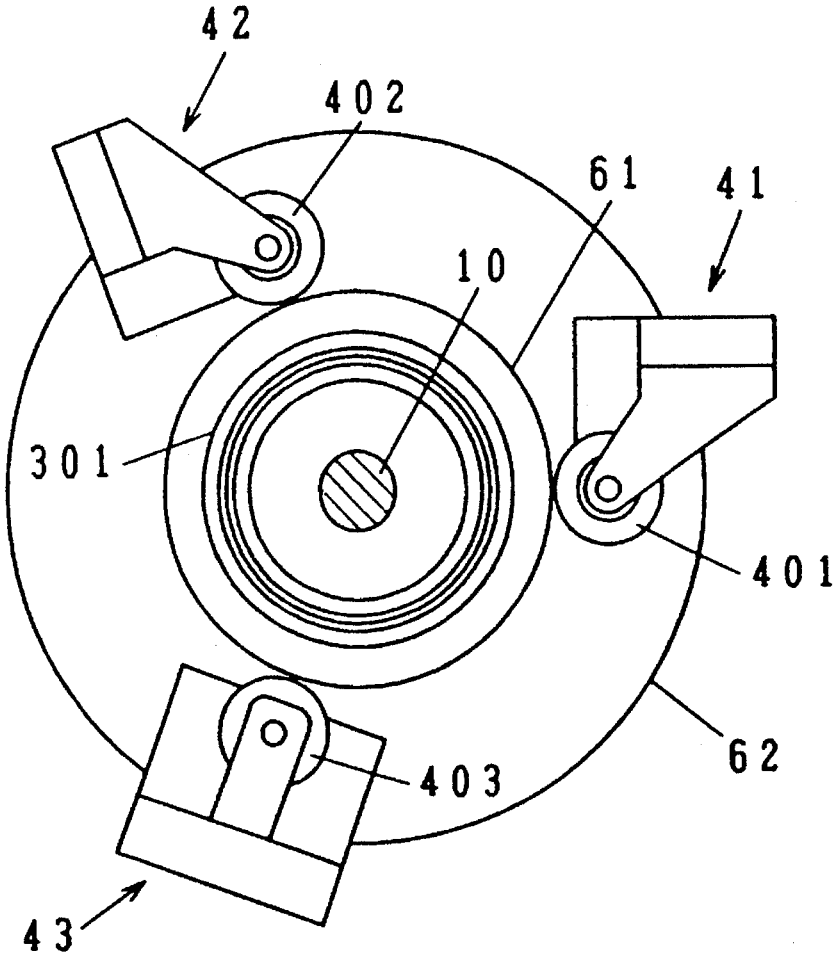
FIG. 3 is a plan view of a set of side roller devices in the apparatus for performing the method of the invention.
Figure 4:
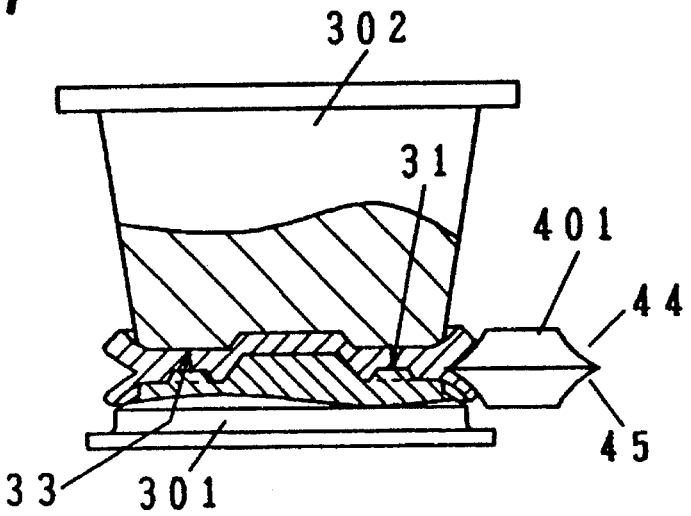
FIG. 4 is a partially-sectional view of the material, the rams and one roller at an early stage of forging.

Embodiment 1 aims at producing an automobile wheel having a disc part and a rim part as one from a initial of column material (10), as shown in FIG. 1(*a*). FIG. 2 shows an apparatus for shaping such an automobile wheel. The apparatus has a pair of rams (301) and (302) facing each other in the vertical direction. The lower ram (301) is a fixed one. The upper ram (302) is a movable one which is displaceable up and down. The center line of the upper ram (302) coincides with the center line of the lower ram (301). Three rollers (401), (402) and (403) are disposed at three points around the rams (301) and (302). The three rollers can be displaced multidirectionally by some distances. The carving roller (401) carves an outer surface of a material block into halves. The first shaping roller (402) shapes an outer half of the drop center (23) and outer rim part (22) shown in FIG. 1*a*. The second shaping roller (403) forms an inner half of the drop center (23) and an inner rim part (24). These three rollers are a set of forming rollers which play an important role in this invention.

The upper ram (302) is maintained by a holder (5). A frame (50) has a top deck (51). The top deck (51) of the frame (50) supports an oil pressure apparatus (52). The holder (5) is connected to an output shaft of the oil pressure apparatus (52). The oil pressure apparatus (52) lifts up or presses down the upper ram (302).

The upper surface of the lower ram (301) is a first pressing surface (31) which is a negative of the desired shape of the outer side of the disc part (1) of a wheel. The first pressing surface (31) is shaped after the disc part (1). The disc part (1) will have concave or convex patterns. The first pressing surface must have negative patterns similar to the concave or convex patterns of the disc part (1). The relation of convex and concave portions is reversed as between the first pressing surface (31) and the desired disc part (1). An outer peripheral surface (32) has a slanting surface portion (32A) having the sectional shape which is a negative of a part of the desired drop center (23), and the desired inner and outer surfaces of the outer rim (22).

Similarly tile upper ram (302) has a second pressing surface (33) which is a negative of the desired inner side of the disc part (1). An outer slanting surface (34) of the upper ram (302) has a section which is a negative of another part of the drop center (23), and inner and outer surfaces of the inner rim part (24).

Three roller devices (41), (42) and (43) are disposed at three-fold symmetric positions around the interface between the upper ram (302) and the lower ram (301). The lower ram (301) is mounted on a fixed bed (61). Thus, the lower ram (301) is at rest in the embodiment. The three roller devices are installed upon a rotary bed (62) which rotates concentrically around the static bed (61). The first roller device (41) has the carving roller (401). The second roller device (42) has the first shaping roller (402). The third roller device (43) has the second shaping roller (403). The three roller devices are arranged counterclockwise in the order of the first roller device (41), the second roller device (42) and the third roller device (42.). Each roller device has a roller and a bracket supporting the roller. All the brackets can be displaced both in a radial direction and in a vertical direction. Furthermore, the bracket of the third roller device (43) also can be displaced in an angular direction in order to change the posture of the second shaping roller (403), in addition to the radial or vertical movement.

The movements of the brackets are controlled by oil pressure. Therefore, the lower portion of the rotary bed (62) is provided with a junction device of oil circuits which can rotate relative to the rotary bed (62). An example of the oil circuit junction device is constituted of an annular joint (63) coaxial to the rotary bed (62), several grooves formed on an outer, lower surface of the rotary bed (62) and the same number of grooves shaped on an inner surface of the annular joint (63). Each of the grooves of the rotary bed (62) coincides with one of the grooves of the annular joint (63). There is a sealing device between the inner surface of the joint (63) and the outer surface of the rotary bed (62). Therefore, no oil leaks from the pair of grooves of the oil circuit junction device in spite of the relative rotation of the rotary bed (62). An oil pressure source (65) supplies pressurized oil via a controlling valve unit (64) to oil pressure circuits in the annular joint (63) and the rotary bed (62). The controlling valve unit (64) contains plural controlling valves. Each of the oil circuits is independently adjusted by some controlling valves. For example, a microcomputer determines the positions of the brackets of the rollers and the posture of the second shaping roller (403) by adjusting the degrees of opening of the controlling valves.

The rotary bed (62) is rotatably supported by the fixed bed (61). A wide bevel gear is formed around the rotary bed (62). Another small bevel gear is fitted to an output shaft of a reduction gear (67). A driving motor (66) rotates an input shaft of the reduction gear (67). The wide bevel gear meshes with the smaller bevel gear. Thus, the driving motor (66) rotates the rotary bed (62) at a reduced rate.

FIG. 2 to FIG. 6 demonstrate how to produce a wheel from an initial material (10). An initially columnar mass of material (10) is inserted into a space between the lower ram (301) and the upper ram (302), as shown in FIG. 2.

The oil pressure apparatus (52) presses down the ram (302) against the initial material. The initial material (10) is squashed between the upper ram (302) and the lower ram (301). The initial material is shaped into a dish-like body after the first pressing surface (31) and the second pressing surface (33). The upper patterns of the dish-like body are a negative of the second pressing plate surface (33) of the upper ram (302). Similarly, the bottom pattern of the dish-like body is a negative of the first pressing surface (31). An extra portion of the material is caused to extrude outward of the interface of the rams (301) and (302).

The rotary bed is rotating then. The carving roller (401) is pressed against the protruding material. The carving roller (401) has pair of symmetric, conically-curved surfaces (44) and (45). The boundary of two conical surfaces is a sharp, circular edge. The carving roller (401) resembles a bead of an abacus. The sharp edge of the carving roller (401) thrusts into the protruding material. The bracket (41) of the carving roller (401) revolves around the center line of the rams (301) and (302). Since the carving roller (401) is a free wheel, the carving roller (401) rotates around the axis of the bracket at the same line velocity of revolution around the center line. The sharp edge divides the protruding material extruded from the interface of the rams (301) and (302), into halves. As the upper ram and the lower ram press against the material, the protruding parts are pushed upward or downward by the carving roller (401).

Figure 5:
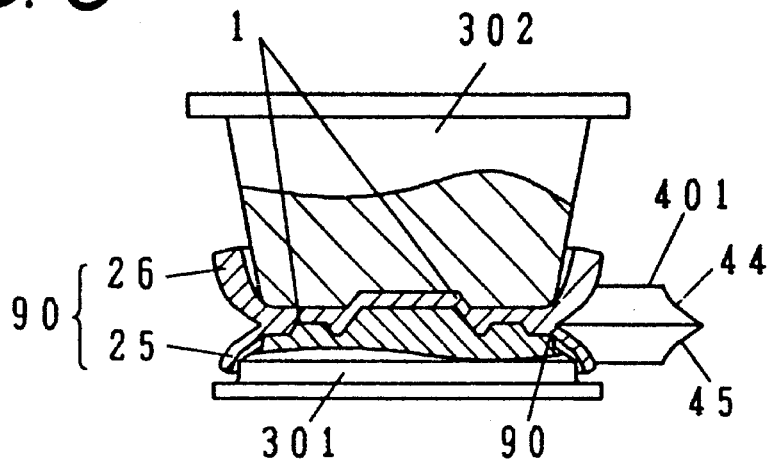
FIG. 5 is a partially-sectional view of the material, rams and roller at the final stage of forging.
Figure 6:
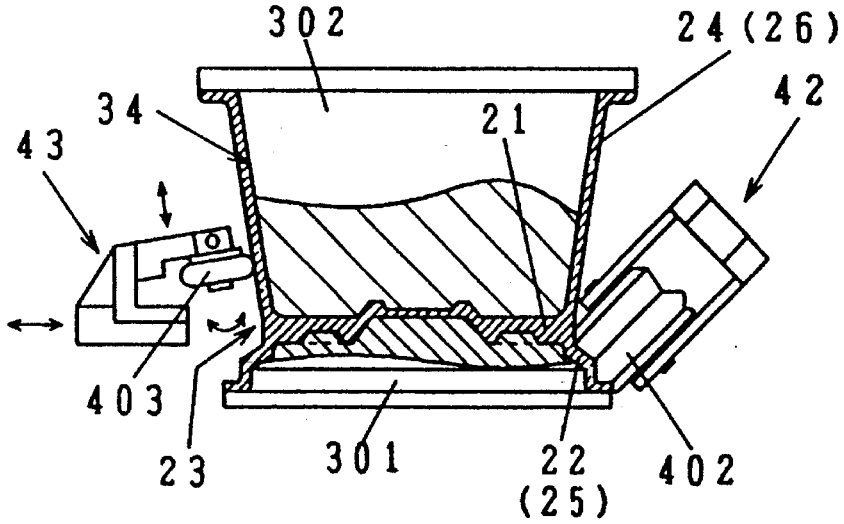
FIG. 6 is a sectional view of the material, rams and two of the roller devices at the process for forming the rim parts.

When the upper ram (302) attains the lowest position, the material (10) is shaped into an intermediate form shown by FIG. 5. The intermediate form has a disc part which has upper and lower surfaces that respectively conform to the first pressing surface (31) of the lower ram (301) and the second pressing surface (33) of the upper ram (302), and has an annular part consisting of an outer bend (25) and an inner bend (26). The outer bend (25) is a part which will be shaped into a part of a drop center (23) and an outer rim (22). The inner bend (26) is a part which will be shaped into another part of the drop center (23) and an inner rim (24).

When the carving process has been completed, the carving roller (401) recedes from the intermediate form. The first shaping roller (402) comes into contact with the outer bend (25). The first shaping roller (402) shapes the outer bend (25) into part of the drop center (23) and the outer rim (22). The section of the first shaping roller (402) is a negative of the desired section of the outer surface of the drop center (23) and the outer rim (22). The section of the lower ram (301) is similarly a negative of the desired section of the inner surface of the drop center (23) and the outer rim (22). Therefore, the drop center (23) and the outer rim (22) are formed by tile rolling of the first shaping roller (402) on the outer bend (25).

The second shaping roller (403) comes into contact with the inner bend (26) either in coincidence with or posterior to the formation of the outer rim (22). In the embodiment, the third roller device (43) having tile second shaping roller (403) is a spinning roller device which adjusts the posture of the second shaping roller (403) and displaces the second shaping roller up and down. The second shaping roller (403) presses, extends and shapes the inner bend (26) into a thin conical part which is a negative of the peripheral slanting surface (34) of the upper ram (302). Thus, the third roller device (43) makes a part of the drop center (23) and the inner rim (24). The second shaping roller (403) then recedes and separates from the inner rim (24).

When the rolling processes by the rollers (401), (402) and (403) have been completed, a wheel having a disc part (1) and rim parts (2) is produced around and between the rams (301) and (302). The fixed bed (61) is provided at its center with a knockout device (68). An output shaft of the knockout device (68) penetrates a top hole of the lower ram (301). The output shaft has a plate (69) which has the same shape as the disc part (1) of the wheel has. The wheel can be pushed upward off of the ram (301) by projecting the output shaft of the knockout device (68).

Then the wheel is removed from the shaping apparatus. The output shaft is restored to it downward initial position. Another initial mass of material is supplied between the upper ram (302) and the lower ram (301). Then another cycle of shaping of another wheel will be repeated. The wheel shaped by the apparatus will be further processed by finish punching, flash elimination, finish cutting and finish grinding.

In the embodiment, the volume of the initial material must be equalized to the volume of tile wheel which should be produced.

The carving roller (401) can be displaced both in the vertical direction and in the horizontal direction. The vertical displacement of the carving roller (401) changes the allotment of the material to the outer bend (25) and the inner bend (26). Although the lengths of the bends are equal, the volumes of the bends are different, because tile thicknesses differ from each other. If the carving roller (401) is set at a higher level, the inner bend (26) becomes thinner and the outer bend (25) becomes thicker than would result if that roller is set at a lower position. The ratio of the volume of the outer bend (25) to that of the inner bend (26) can be properly adjusted by setting the height of the carving roller so that the outer bend thicker than the inner bend (26).

Figure 7:
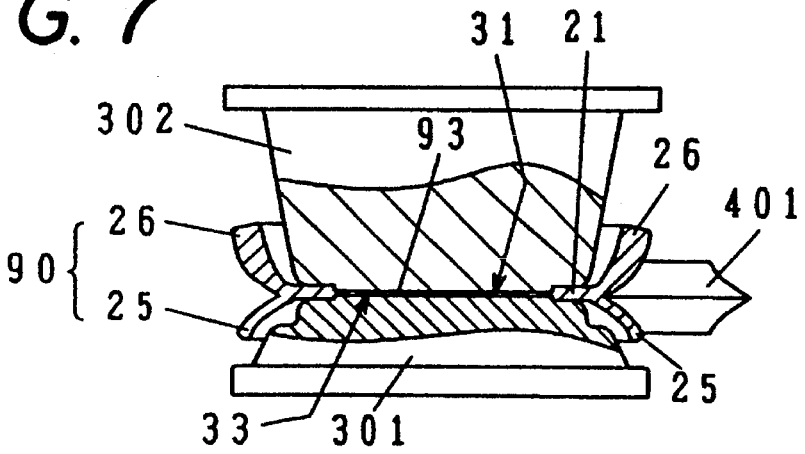
FIG. 7 is a sectional view of the material having a wide central opening at a disc part, the rams and a roller, at an early step of forging.

In the embodiment, the disc part (1) has been formed in a shape which coincides with the disc of a wheel. Another disc part (1) as shown In FIG. 1(*b*) is also available. The disc has a large opening and a narrow rim flange (21). An individual disc will be connected to the rim flange (21). To obtain the disc part in the latter version, the first pressing surface (31) of the lower ram (301) should have a negative of the shape of the outer surface of the rim flange (21). The second pressing surface (33) of tile upper ram (302) has shape which is a negative of the inner surface of the ram flange (21). FIG. 7 shows the state in which the upper ram (302) anti the carving roller (401) have formed the intermediate body for obtaining the version of FIG. 1(*b*). The upper ram (302) is positioned at the lowest level. The carving roller (401) divides the bends (25) and (26). The rams (301) and (302) sandwich a peripheral rim flange (21) and a central thin part (93) which will be eliminated afterward.

In this ease, the apparatus produces a partial wheel which consists only of a rim part and a rim flange in a body. The central thin part is eliminated by punching, when the partial wheel has been removed from between the rams (301) and (302). Many bolt holes are punched at designated intervals on the rim flange (21) simultaneous with the punching out of the central thin part. The partial wheel is made up to form a complete wheel by coupling it to an individual disc with bolts.

EMBODIMENT 2

Embodiment 1 of the method of the invention includes rotation the roller devices (41), (42) and (43) around the fixed rams (301) and (302). What is important is the relative rotation between the rams and the rollers. Therefore, it is possible as an alternative to fix roller devices and rotate the rams (301) and (302) at the same angular velocity.

Figure 8:
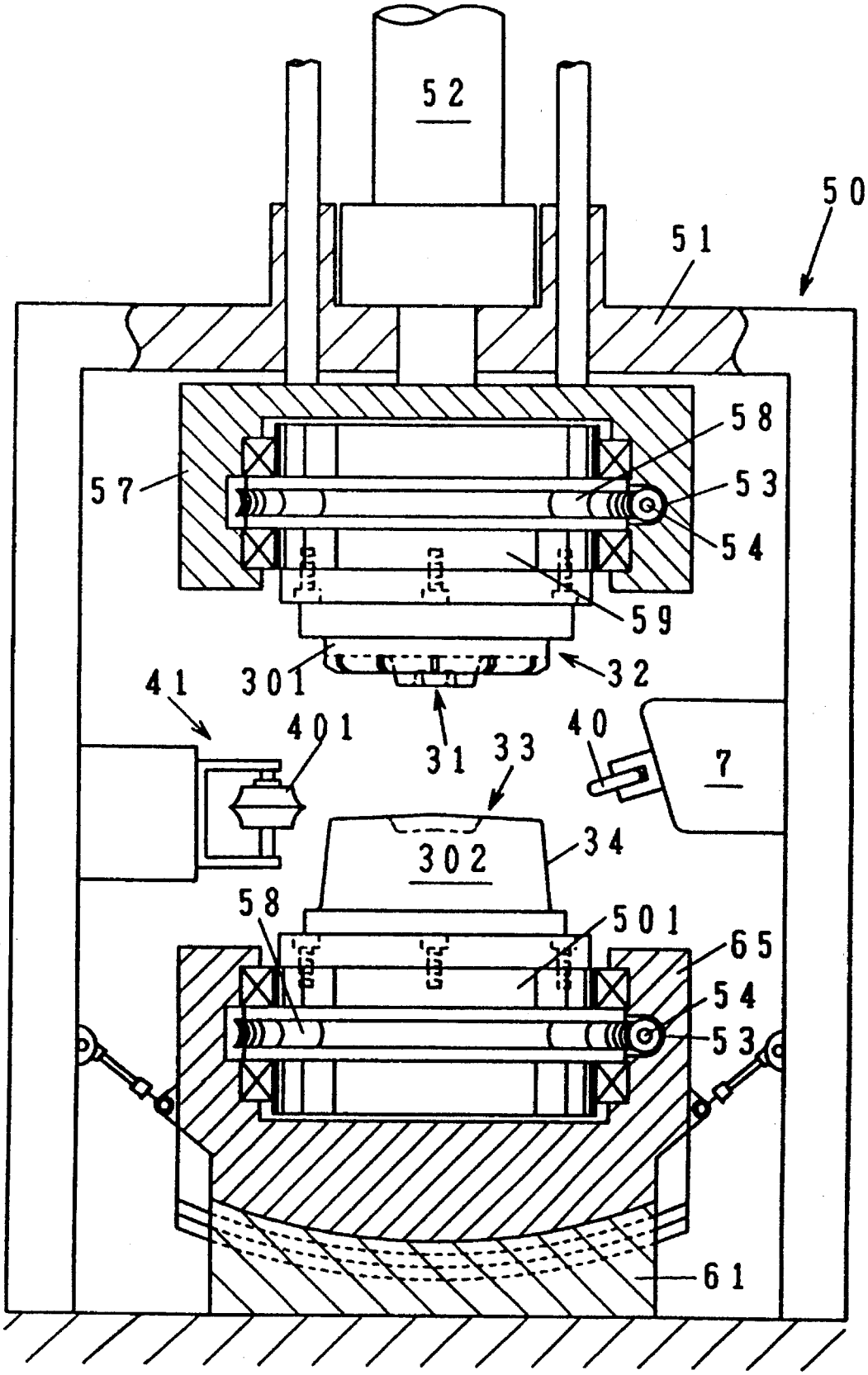
FIG. 8 is a sectional view of another apparatus for carrying out this invention.

For example, such an apparatus as is illustrated in FIG. 8 is available. The top deck (51) of the frame (50) suspends the upper ram (301). The fixed bed (61) sustains the lower ram (302). A cylindrical holder (57) hanging from the top deck (51) has as bottom opening in which a supporting plate (59) is rotatably mounted. The upper ram (301) is fixed to the bottom of the supporting plate (59). The holder (57) is fitted to an output shaft of the oil pressure device (52). Guide posts fixed to the holder (57) penetrate holes in the deck (51). The oil pressure device can lift or lower the holder (57). The supporting plate (59) can rotate with respect to the holder (57). A worm wheel (58) is fitted around the supporting plate (59). The holder (57) has a driving motor (not shown in the figures) with an output shaft (54) for rotating the ram (301) and a worm (53) fitted to the output shaft (54). When the driving motor rotates the worm (54), the worm wheel and the ram (301) revolve at a reduced velocity. Therefore the upper ram (301) is rotated by the driving motor and the worm gear device and is lifted up or down by the oil pressure device (52).

The lower ram (302) is fixed on a sustaining plate (501) which is furnished in a holder (65). The holder (65) is laid on the fixed bed (61). The sustaining plate (501) has the worm wheel (58) around the periphery. A driving motor (not shown in the figures) with an output shaft (54) is installed in the holder (65) like the upper ram. A worm (53) is Fixed to the output shaft (54). The worm (53) meshes with the worm wheel (58) around the sustaining plate (59). Thus the lower ram (302) is rotated by the driving motor and the worm gear device. The angular velocity of the lower ram (302) is equal to that of the upper ram (301).

A first roller device (41) having a carving roller (401) is furnished on a side wall of the frame (50). Oil pressure devices can displace tile carving roller (401) both in the horizontal direction and in the vertical direction. A roller device (7) having a shaping roller (40) is installed on another side wall of the frame (50). Similarly, the oil pressure devices can displace the shaping roller (40) both in the horizontal direction and in the vertical direction. Another oil pressure device can adjust the posture of the shaping roller. The roller device (7) is a conventional spinning roller device.

The function of the embodiment will now be explained. An initial mass of material (10) is laid between the upper ram (301) and the lower ram (302). The upper ram (301) is lowered by the oil pressure device (52). The rams (301) and (302) press the initial material so that it is extruded outward beyond the outer peripheral surfaces (34) and (32) of tile rams (302) and (301) and is divided into two parts by the first roller device (41). The roller device (7) presses and shapes the rim parts (2) by the spinning roll process.

This invention has several versions in addition to the embodiments mentioned before.

Figure 9:
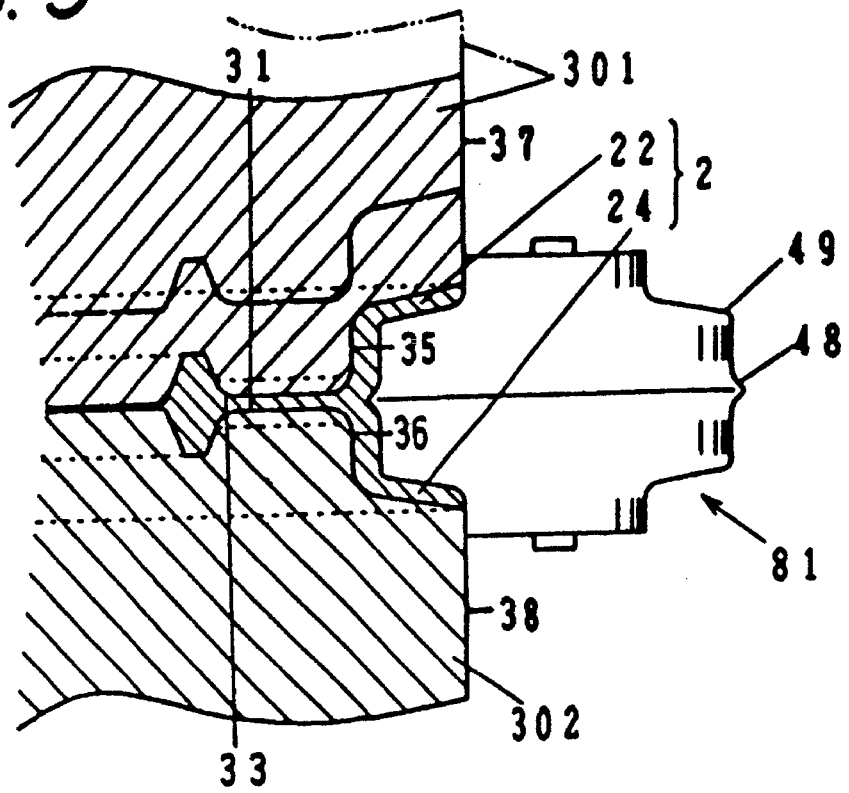
FIG. 9 is a sectional view of the material, rams and a side roller for an exemplary method for shaping a V-belt pulley in a single process.

① The embodiments have been explained as to manufacture of wheels of automobiles. However, this invention can be applied to other kinds of wheels, for example wheels for light wagons or pulleys. In this case, a final product can be integrally shaped by a unified processing roller (81) having a carving edge part (48) and shaping roller parts (49), as shown in FIG. 9. Especially, in the case of a V-belt pulley, the unified roller (81) can shape and finish a final product at the same time in cooperation with indented surface portions (35) and (36) of the rams (301) and (302) between outer peripheral surfaces (37) and (38) and pressing surfaces (31) and (33), because a V-belt has an outer rim (22) and an inner rim (24) which are symmetric with regard to the central plane. Some pulleys require no carving edge part (48) for the processing roller.

Furthermore, in the case of a flat belt-pulley, the processing roller is a simple columnar roller (82). The side shapes of the rams (301) and (302) have been formed with indented surface portions (39) and (39') to coincide with the inner surface of the rim part. The extruded portion becomes a rim part which will used to contact a belt.

Figure 10:
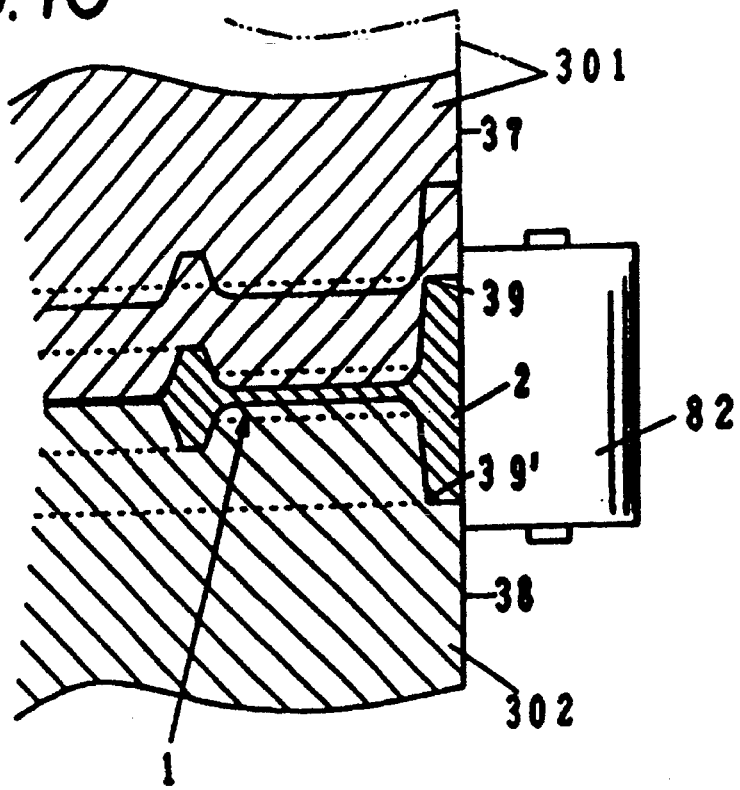
FIG. 10 is a sectional view of the material, rams and side roller in another exemplary apparatus for producing a flat-belt pulley.

In any case, the side ends of the upper ram (301) and the lower ram (302) shall be in contact with the end of the processing roller (81) or (82), when the rim parts have been formed. Such contact is required only at the end stage of the formation. The side of the lower ram (302) is always in contact with the part of the processing roller (81) or the columnar roller (82) during the shaping process. But when the shaping process is in progress, it is allowable for the upper ram (301) to be separated from the upper side of the processing roller (81) or the columnar roller (82), as shown by double-dotted lines in FIG. 9 or FIG. 10. Then at the final stage, the bottom side of the upper ram (301) becomes in contact with the processing roller (81) or the columnar roller (82).

This version, which relies upon an integrated, unified roller, has been described for a process in which light wagons or pulleys are produced. But this version can also be applied to the production of automobile wheels. In this case, the shapes of the sides of the rams (301) and (302) shall be the negatives of the automobile wheel at the inner surfaces of the rim part. The unified processing roller (81) shall be harmonized with the sectional shape of the outer surface of the rim part.

Figure 11:
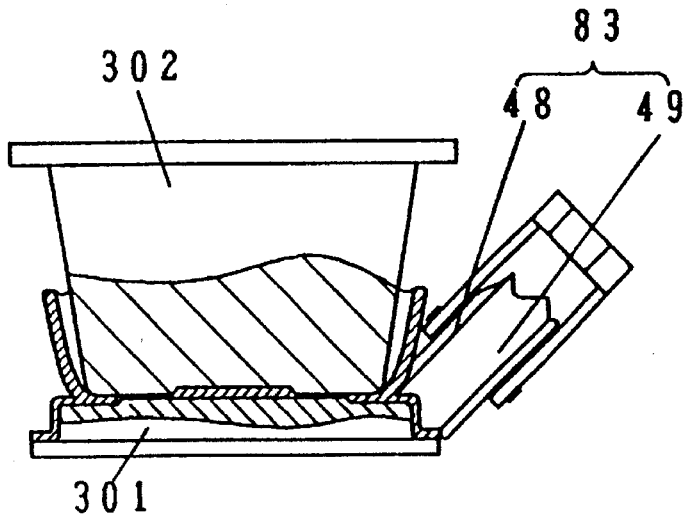
FIG. 11 is a sectional view of the material, rams and side roller of another exemplary apparatus for integrating the processes of carving and formation of the outer rim into a single process.
Figure 12:
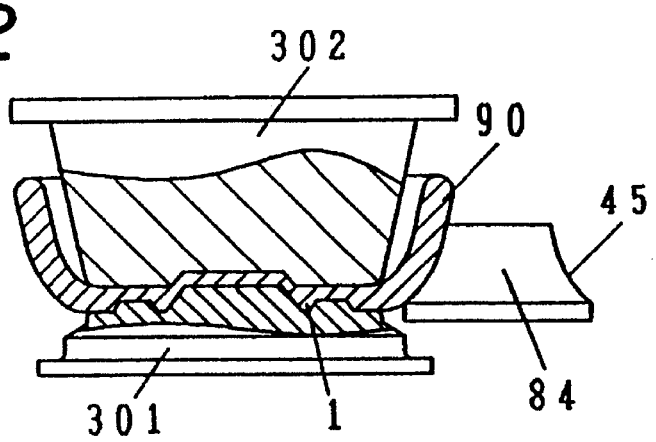
FIG. 12 is a sectional view of tile material, rams and side roller of an exemplary apparatus for producing the dish-like prototype having an annulus around a disc part.

② Embodiment 1 includes a roller unit having the first roller device (41) with the carving roller (401) and the second roller device; (42) with the first shaping roller (402), provided independently. In the case of high asymmetry of the rim part to the disc part, namely when the outer rim part is much narrower than the inner rim part, the two roller devices can be unified into a single roller device. FIG. 11 illustrates an example of a unified roller. The unified processing roller (83) integrates a shaping roller part (49) and a carving edge part (48) in series along the axial line. The integrated roller (83) enables the carving edge part (48) to divide the material into an upper bend and a lower bend and enables the processing roller part (49) to shape the outer rim (22) and a part or the drop center (23) at the same time.

③ Both embodiment 1 and embodiment 2 have employed the carving roller in order to divide the material for forming rim parts on both sides of the disc part. However, when the rim part lacks either of the rim parts and only a bending annulus (90) is formed as a rim part, a simplified roller device can replace the previously described roller devices. The roller unit shall have only a conical processing roller (84) having an arc section. When the rams (302) and (301) press an initial mass of material, a peripheral part of the material is extruded out from between the rams. The conical processing roller (84) is pressed against the extruded out portion. As the rams extrude the material, the extruded out portion is bent upward by the processing roller (83). Finally, the material is formed into a prototype having the disc part (1) and the bending annulus (90) projecting only to one direction from the periphery of the disc part (1). The prototype has a dish-like shape. Depending on the type of wheels desired, the dish-like prototypes can be adopted as final products.

Figure 13:
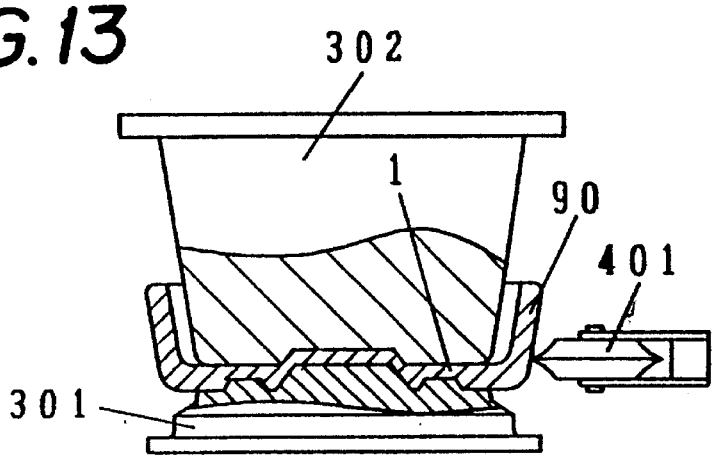
FIG. 13 is a sectional view of the material, rams and side roller at an early age of an exemplary for carving process.
Figure 14:
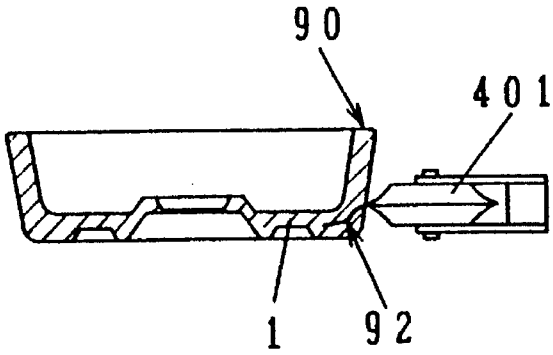
FIG. 14 is a sectional view of the material of the carving process showing tile locus of the carving.
Figure 15:
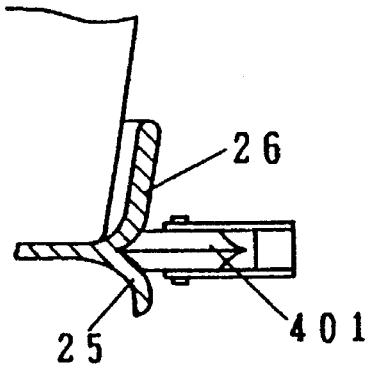
FIG. 15 is a partially-sectioned view of the material ram and side roller, showing carving out an annulus of material from the dish-like body.

For other types of wheels, the prototypes shall be further shaped by performing further processes on the products obtained by embodiment 1 and embodiment 2. In this case, the dish-shaped prototype shall be carved by the carving roller (401) posteriorly, as shogun in FIG. 13, FIG. 14 and FIG. 15. FIG. 13 illustrates the beginning of the posterior carving by the abacus-bead-like roller (401). FIG. 14 shows the locus (92) along which the edge of the carving shall progress. The carving locus (92) shall be determined by the ratio of the volume of the inner rim part to that of the outer rim part. Then the carving roller (401) cuts its way along the determined locus (92). The outer rim part (22) and the inner rim part (24) are formed, as shown by FIG. 15.

Figure 16:
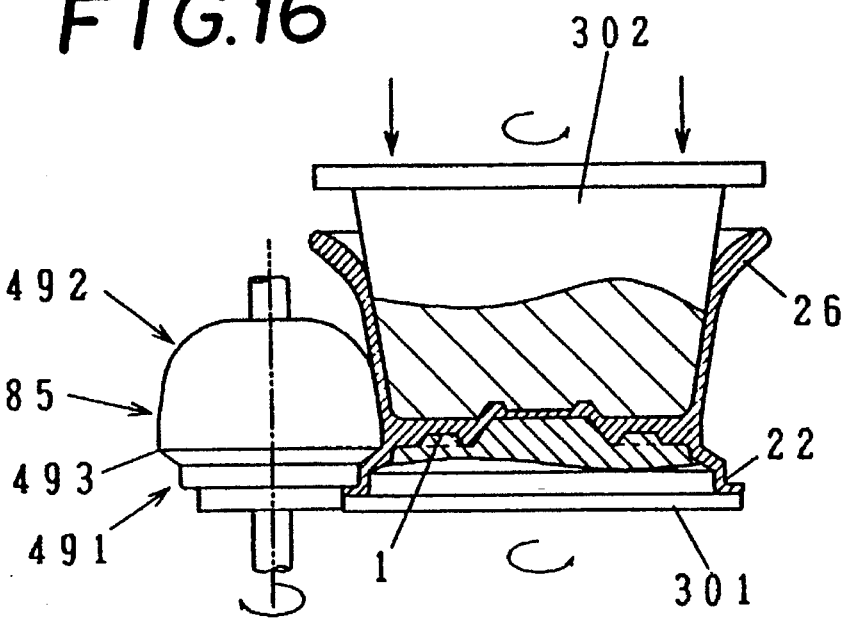
FIG. 16 is a sectional view of the material, rams and side roller in which a single process carries out the carving and formation of an outer rim part.

④ FIG. 16 shows another version of simultaneous carving and outer rim formation. The lower ram (301) has a sectional shape which is a negative of the desired drop center and the outer rim (22). The integrated, processing roller (85) similarly has a shaping roller part (491), an expanding roller part (492) and a carving roller part (493). The carving roller part (493) is an interface between the shaping roller part (491) and the expanding roller part (492). The carving roller divides the material in two and shapes the drop center part. The lower shaping roller part (491) has been modeled after the drop center and the outer rim part (22). The upper, expanding roller part (492) has an arc-shaped section. The processing roller (85) is furnished at a certain point in the vicinity of the power ram (301). The relative height and the relative distance of the roller (85) to the lower ram (301) have been properly determined.

The upper ram (302) has been modeled upon the inner rim part (24) and the drop center. The pair of the rams (302) and (301) sandwich and press an initial mass of material. Then the rams rotate around the center axis. The upper ram (302) squashes the initial material. Some portion is extruded out from between the rams. The extruded out portion is shaped by the processing roller (85). The carving roller part (493) divides the portion into two parts. The lower allocated portion fills the space between the shaping roller part (491) anti the lower ram (301). This portion is finished as the outer rim (22). On the other hand, the rest of the extruded out part rises in the narrow space between the upper ram (302) and the processing roller (85), as the upper ram (302) is lowered. The portion of the material is pressed into the upper bend (26), as shown in FIG. 16. Then the upper bend (26) will be further formed into the inner rim (24) by an additional roller process.

What is claimed is:

1. A method of shaping a wheel having a disc part and a rim part extending in an axial direction, the rim part having an inner rim and an outer rim, from an initial mass of material with plasticity, comprising the steps of:

a. pressing the initial mass of material in an axial direction with a pair of opposing rams, each ram having a pressing surface and an outer peripheral surface, b. forming the disc part between the rams, c. extruding a portion of the initial mass of material out from between the rams to the outer peripheral surface of each of the rams, and d. during said step c, forming the extruded portion into the rim part with a first roller unit and a second roller unit, each roller unit having at least one forming roller which rotates relative to the rams at the outer peripheral surfaces of the rams, the first and second roller units simultaneously forming the inner and outer rims.

2. A method of shaping a wheel as claimed in claim 1, wherein each of the roller units includes a plurality of rollers and forms the rim part therewith, wherein the outer peripheral surfaces of the rams are modeled after an inner surface of the rim part, and wherein the roller rotates relative to the rams by rotation of the rams around an axial line of the rams.

3. A method of shaping a wheel as claimed in claim 2, wherein each of the roller units includes a processing roller having shaping roller parts with sectional surfaces which conform to the outer surface of the rim part, wherein the relative position of the processing roller to either of the rams is predetermined both in the axial direction and in the radial direction, wherein the shape of the space between peripheral surfaces at the periphery of the rams and outer surfaces of the shaping roller parts is the same as the shape of the rim part and the rim part is shaped by pressing the extruded portion into the space between the rams and the shaping roller parts.

4. A method of shaping a wheel as claimed in claim 3, wherein each pressing roller is a columnar roller which has an axis fixed parallel with the axis of the rams, and the columnar roller shapes the outer surface of the extruded portion into a cylindrical shade.

5. A method of shaping a wheel as claimed in claim 2, wherein said step d includes the steps of carving the extruded portion with a carving roller into an inner bend and an outer bend, and roll-shaping the bends with shaping rollers into the rim part.

6. A method of shaping a wheel as claimed in claim 5, wherein said step of roll-shaping is performed simultaneously with said step of carving.

7. A method of shaping a wheel as claimed in claim 6, wherein the simultaneous steps of carving and roll-shaping are performed by a processing roller which includes a carving edge part and a shaping roller part, and said step d includes the step of pushing the extruded portion into a space sandwiched between the ram and the processing roller.

8. A method of shaping a wheel as claimed in claim 5, wherein said step of roll-shaping progresses simultaneously with said step of carving by employing a processing roller unifying a carving edge part and a shaping roller part for shaping the outer rim.

9. A method of shaping a wheel as claimed in claim 2, wherein said step d includes the steps of bending the extruded portion to one of the rams into a bent annulus with a conical processing roller carving the bent annulus into an inner bend and an outer bend, and roll-shaping the inner bend and the outer bend into the inner rim part and an outer rim part.

10. A method of shaping a wheel as claimed in claim 9, wherein said step of roll-shaping includes roll-shaping the outer bend into the outer rim part simultaneously with said step of carving by employing a processing roller unifying a carving edge part and a shaping roller part for shaping the outer rim part.

11. A method of shaping a wheel as claimed in claim 2, wherein said step b includes forming the disc part so as to have only a rim flange extending inward from the rim part.

12. A method of shaping a wheel as claimed in claim 1, wherein the rams are moved only in the axial direction during said step a.

13. A method for forming a wheel as claimed in claim 1, wherein the inner and outer rims are formed to be of different lengths.

14. A method of shaping a wheel having a disc part and a rim part extending in an axial direction, from an initial mass of material with plasticity, the rim part including an inner rim part and an outer rim part, said method comprising the steps of:

a. pressing the initial mass of material in an axial direction with a pair of opposing rams, b. forming the disc part between the rams, c. extruding a portion of the initial mass of material out from between the rams to a periphery of the rams, and d. during said step c, forming the extruded portion into the rim part with a first roller unit which has a unified processing roller having a carving edge part and second and third shaping roller parts formed in series, wherein the position of the processing roller relative to either of the rams is determined both in the axial direction and in a radial direction, wherein the shape of a space between the rams and the second and third shaping roller parts is the same as the shape of the inner rim part and the outer rim part; and wherein said step d includes dividing the extruded portion with the carving edge part into two portions, so that the two portions penetrate into the space between the rams and the shaping roller parts, and the inner rim part and the outer rim part are simultaneously shaped by the rams and the shaping roller parts.

15. A method for forming a wheel as claimed in claim 14, wherein the inner rim part and the outer rim part are formed to be of different lengths.

16. A method of shaping a wheel having a disc part and a rim part extending in an axial direction, the rim part including an inner rim part and an outer rim part, from an initial mass of plasticized material, comprising the steps of:

i. pressing the initial mass of material only in the axial direction between a pair of opposing axially aligned rams so as to form the disc part between the rams, the rams having respective opposing pressing surfaces and respective outer peripheral surfaces;

ii. extruding a portion of the initial mass of material in a radial direction from between the rams to beyond the outer peripheral surfaces of the rams simultaneously with a latter period of said step i; and iii. forming the extruded portion into the inner and outer rim parts simultaneously, using a first roller unit and a second roller unit, each having a forming roller, including rotating the forming rollers relative to the rams on the extruded portion, with the extruded portion between the roller units and the outer peripheral surfaces of the rams, simultaneously with said step ii.

17. A method for forming a wheel as claimed in claim 16, wherein the inner rim part and the outer rim part are formed to be of different lengths.

18. A method for forming a wheel having a disc part and a rim part with an inner rim and an outer rim, the method comprising the steps of:

pressing an initial mass of material between a first ram and a second ram so that a portion of the material protrudes beyond a peripheral edge of the rams;

carving the portion of material into an inner bend and an outer bend; and simultaneously shaping the inner bend and outer bend into the inner and outer rims, respectively.

19. A method for forming a wheel as claimed in claim 18, wherein the carving step includes using a carving roller to allot the material between the first and second bends based upon position of the carving roller.

20. A method for forming a wheel as claimed in claim 18, wherein the pressing step includes moving the first and second rams so as to squash the mass of material into a pancake-shaped piece which is a disc part and allowing the protruding portion to protrude beyond the peripheral surface of the rams.

21. A method for forming a wheel as claimed in claim 18, wherein the shaping step includes using a first shaping roller to form the inner rim part and a second shaping roller to form the outer rim part.

22. A method for forming a wheel as claimed in claim 21, wherein the using step includes imparting a shape of the first ram to the inner rim by pressing the inner bend between the first shaping roller and the first ram, and imparting a shape of the second ram to the outer rim by pressing the outer bend between the second shaping roller and the second ram.

23. A method for forming a wheel as claimed in claim 18, wherein the carving and shaping steps occur simultaneously.

* * * * *